US012295487B2

(12) United States Patent
Spear et al.

(10) Patent No.: US 12,295,487 B2
(45) Date of Patent: May 13, 2025

(54) BOTTLE-CLEANING UTENSIL AND METHOD OF USE

(71) Applicants: Riley Spear, Eagle Mountain, UT (US); Joshua Stewart, Florence, KY (US)

(72) Inventors: Riley Spear, Eagle Mountain, UT (US); Joshua Stewart, Florence, KY (US)

( * ) Notice: Subject to any disclaimer, the term of this patent is extended or adjusted under 35 U.S.C. 154(b) by 971 days.

(21) Appl. No.: 17/013,818

(22) Filed: Sep. 7, 2020

(65) Prior Publication Data

US 2021/0068525 A1 Mar. 11, 2021

Related U.S. Application Data

(60) Provisional application No. 62/897,008, filed on Sep. 6, 2019.

(51) Int. Cl.
*A46B 9/02* (2006.01)

(52) U.S. Cl.
CPC ..... *A46B 9/025* (2013.01); *A46B 9/026* (2013.01); *A46B 2200/3006* (2013.01)

(58) Field of Classification Search
None
See application file for complete search history.

(56) References Cited

U.S. PATENT DOCUMENTS

2016/0073770 A1* 3/2016 Stokes ..... A47L 17/00 134/8

FOREIGN PATENT DOCUMENTS

| | | | | |
|---|---|---|---|---|
| JP | H0717380 | * 3/1995 | ..... | B08B 7/0203 |
| JP | 3105697 | * 11/2004 | ..... | D06F 35/00 |
| KR | 20090011316 | * 11/2009 | ..... | Y02B 40/00 |
| KR | 20100026572 | * 3/2010 | ..... | A47L 17/08 |

OTHER PUBLICATIONS

JPH0717380 English translation, accessed on Jun. 2023. (Year: 1995).*
KR20100026572 English translation, accessed on Jun. 2023. (Year: 2010).*
KR20090011316 English translation, accessed on Jun. 2023. (Year: 2009).*
JP3105697 English translation, accessed on Jun. 2023. (Year: 2004).*

* cited by examiner

*Primary Examiner* — Eric W Golightly
*Assistant Examiner* — Arlyn I Rivera-Cordero
(74) *Attorney, Agent, or Firm* — Ongs Law Firm, PLLC; Jacob Ong

(57) ABSTRACT

A cleaning utensil is disclosed; the utensil may have a core and bristle holders for holding bristle assemblies; the cleaning utensil may be in the shape of a trigonal pyramid.

15 Claims, 12 Drawing Sheets

BOTTLE-CLEANING UTENSIL AND METHOD OF USE

TECHNICAL FIELD

The disclosure relates generally to an apparatus for cleaning a container, such as a bottle or jar. Specifically, the disclosure relates to a cleaning utensil removing bacteria or bacterial biofilms from a container.

BACKGROUND

Water bottles, baby bottles, kitchen containers, and camping gear are known for being difficult to clean. Hand-held bottle washing implements, e.g., brushes, used for washing bottles and similar kitchen objects are generally known.

These implements, however, are subject to limitations. When being used, the shape of a typical brushes may not sufficiently contact corners or other areas of a bottle. Another challenge is generating sufficient pressure to remove bacteria biofilm from the inside of a bottle, even with the use of a typical brush. Additionally, the shape of a bottle and its neck may limit the angles at which a user may orient atypical handle of a brush while scrubbing. The aforementioned limitations may contribute to a need for increased time spent with the brush on the bottle, which may then deter users from frequently or diligently cleaning bottles using the aforementioned brushes. And then a user may find it difficult to clean the bristles of a brush or carry the brush when traveling if bag space is limited.

BRIEF SUMMARY

A cleaning utensil for cleaning the interior surface of a container is disclosed. The cleaning utensil may be called a scrubber ball and may have a central base which may be surrounded by a plurality of bristles or brushes. Various patterns may be used for the bristles; the drawings only show one embodiment. The pattern of the bristles may be a plurality of parallel lines or may be a single zig-zag line. The pattern of the bristles may also have a plurality of lines that are crossed, similar to an "X".

DETAILED DESCRIPTION

A detailed description of the claimed invention is provided below by example, with reference to examples in the appended figures. Those of skill in the art will recognize that the components and steps of the invention as described by example in the figures below could be arranged and designed in a wide variety of different configurations, without departing from the substance of the claimed invention. Thus, the detailed description of the examples in the figures is merely representative of an example of the invention, and is not intended to limit the scope of the invention as claimed.

The central base may also be termed a core. In the preferred embodiments, the central base has at least four bristle holders.

In some instances, numerical values are used to describe features such as spreading factors, output power, bandwidths, link budgets, data rates, and distances. Though precise numbers are used, one of skill in the art recognizes that small variations in the precisely stated values do not substantially alter the function of the feature being described. In some cases, a variation of up to 50% of the stated value does not alter the function of the feature. Thus, unless otherwise stated, precisely stated values should be read as the stated number, plus or minus a standard variation common and acceptable in the art.

In the preferred embodiments, the central base may have a diameter falling in the range of 3 mm to 10 cm. The central base may have one or more materials, such as a silicone cover covering a metallic sphere.

For purposes of this application, a bristle is defined as a stiff filament.

For purposes of this application, a bristle assembly is defined as at least one bristle.

For purposes of this application, a bristle holder is a housing configured to receive at least one bristle assembly; for purposes of this application, a housing is defined as the portion of a structural member, such as a central base, that defines a void shaped to receive at least one bristle assembly.

In the preferred embodiments, the central base is spherical and also made of metallic materials. The central base may be other shapes, such as a square pyramid, pyramid, trigonal pyramid, cube, cuboid, torus, octahedron, hexagonal pyramid, icosahedron, pentagrammic prism, pentagonal prism, triangular prism, cube, cylinder, dodecahedron, hexagonal prism, tetrahedron, cone, or similarly-shaped shapes. The central base may be dense or it may have bristle holes. The bristles which extend from the central base may be natural, synthetic, or a hybrid of natural and synthetic bristles. The weight of the central base may help provide sufficient inertia so as to achieve an optimal scrub pressure. In the preferred embodiments, the central base exceeds a minimum weight threshold but is also below a maximum weight threshold so as to allow for sufficiently rapid acceleration of the central base when the cleaning utensil has been shaken indirectly by a user who has shaken a bottle in which the cleaning utensil is disposed. In the preferred embodiments, the minimum weight of the central base is between 5 grams and 3 lbs. In some preferred embodiments, the weight of the central base is 10 grams.

In the preferred embodiments, the central base may be a dense sphere which may retain the bristles in a pyramidal formation. In the preferred embodiments, the bristles are arranged in a pyramidal layout such that a plurality of bristles are aligned or define between 1 and 20 geometric planes. In the preferred embodiments, the number of geometric planes that are defined by a plurality of bristles is between 3 and 8 geometric planes. In the preferred embodiments, the number of geometric planes that are defined by a plurality of bristles is four.

Bristles patterns may include random dispersion, spiral, cuboidal, coiled, trigonal pyramidal.

The cleaning utensil may be disposed within a container, such as a bottle. The container may have liquid before the cleaning utensil is added, or the liquid may be added simultaneously to when the utensil is added, or the liquid may be added after the cleaning utensil has been added. A method of use may include rotating the container, with the lid on, in a circular motion to generate centrifugal force, side to side, or up and down, or combinations thereon. Detergent may or may not be added to the liquid. In the preferred embodiments, rotating the container in a circular motion may also cause the utensil to rotate in a circular, substantially circular, or generally circular motion, and the centrifugal force that is generated may cause the utensil to keep at least one plane, which may include three rows of bristles, in full contact or substantially full contact with at least one inner face of the container. The inner face of the container may resist the motion of the cleaning utensil. Given that the cleaning utensil has a mass, then the mass of the device and the g-forces of the centrifugal acceleration experienced by the cleaning utensil when it is being rotated may combine to provide scrubbing pressure that is perpendicular, generally perpendicular, or substantially perpendicular to the face of the container. In the preferred embodiments, the cleaning utensil may have a triangular shape, generally triangular shape, or substantially triangular shape, such that some or all of the bristles may be angled or extend such that they may be inserted or easily inserted into one or more corners of the container, and in the preferred embodiments the scrubbing force is not substantially decreased since only a portion of the bristles may be inserted into a corner at any moment in time and for any bristle that may be inserted into a corner, only a portion of that bristly may be inserted into the corner. the bristles may be sufficiently long such that only an end portion of the bristle may be inserted into the corner. One skilled in the art would testify that a traditional brush that is used for scrubbing the inner surface of a bottle applies scrubbing force in a direction that is parallel, generally parallel, or substantially parallel to the inner surface that is being scrubbed.

The central base may be cast or machined from a dense non-toxic material such as an alloy; the alloy may include a number of materials, such as 100% iron or a combination of two or more materials. In the preferred embodiments, at least one of the materials that make up the central base is metallic. In the preferred embodiments, there are two metals in the alloy for the central base, which may be bismuth and tin. In the preferred embodiments, the content of the alloy is between 40% and 65 bismuth and the remaining material in the alloy may be tin. The percentage of the tin may be 100% minus the percentage of the bismuth. In some preferred embodiments, the alloy is 58% bismuth and 42% tin.

Holes configured for bristles or apertures configured for bristles may be disposed upon the surface of the central base; these holes or apertures may be referred to a bristles hole or bristle holes. A bristle holder is defined as the 3-dimensional area of the central base which defines a hole; the bristle holder includes the bottom surface of the central base that is located at the bottom of the hole. The holes or apertures may be disposed in such a way that a trigonal or triangular pyramid may be formed by the bristles that have been disposed in the bristle holes. In the preferred embodiments, the surface of the central base is generally or substantially smooth; in the preferred embodiments, the surface of the central base is substantially free of defects so as to decrease the likelihood that dirt, soil, bacteria, or other unclean things may be caught inside of the defects.

The minimum length of the bristle that is disposed within a bristle hole is 0.03 mm.

The maximum length of the bristle that is disposed within a bristle hole is 90 cm.

In the preferred embodiments, the length of the bristle that is disposed within a bristle hole ranges between 0.03 mm and 90 cm.

At least 10 percent of the length of the bristles may be disposed within the hole.

In the preferred embodiments, no more than 45% of the bristle is disposed with in the hole.

In the preferred embodiments, the ideal ranges for the length of the bristles is between 5 mm to 15 mm.

One or more of the bristle holes, ideally all of the bristle holes, may receive a number of bristles. The method for forming the central base may be to insert, stuff, or dispose one more bristles into the hole configured for the bristles. The bristles may then be secured in place. Some ways for securing are using an adhesive, such as after drilling a hole and adding an amount of adhesive and then adding the one or more bristles. Bristles may be trimmed so as to form a sharp, angular 4-sided pyramid; a clamp and a leveler may be used during the trimming process. In the preferred embodiments, one or more bristles that are perpendicular to the same cutting plane and a cutting tool, such as a jig, may be positioned at a specific distance from the cutting plane.

1. The bristles may have a coating. Various materials may be used for bristles, including hog hair or synthetic hair.

In the preferred embodiments, the minimum length for a bristle is 0.001 mm and in the preferred embodiments the maximum length is 200 cm. Various bristle stiffness and bristle length may be used. Brushes may have a direct relationship between bristle stiffness and length. In some embodiments, the length of the bristles are between 4 and 7 cm.

The bristles or the surface of the central base may be treated with antimicrobial coatings.

A bristle assembly may have tips of individual bristles that are aligned such as to form an mathematical line defining the edges of a trigonal pyramidal shape.

BRIEF DESCRIPTION OF THE DRAWINGS

A more particular description of the invention briefly described above is made below by reference to specific examples. Several examples are depicted in drawings included with this application. An example is presented to illustrate, but not restrict, the invention. When bristle assembly counts are given in the brief description of the figures, then that represents the total bristle assemblies for the embodiment even if not all shown in that view (unless otherwise noted).

Figure 1:
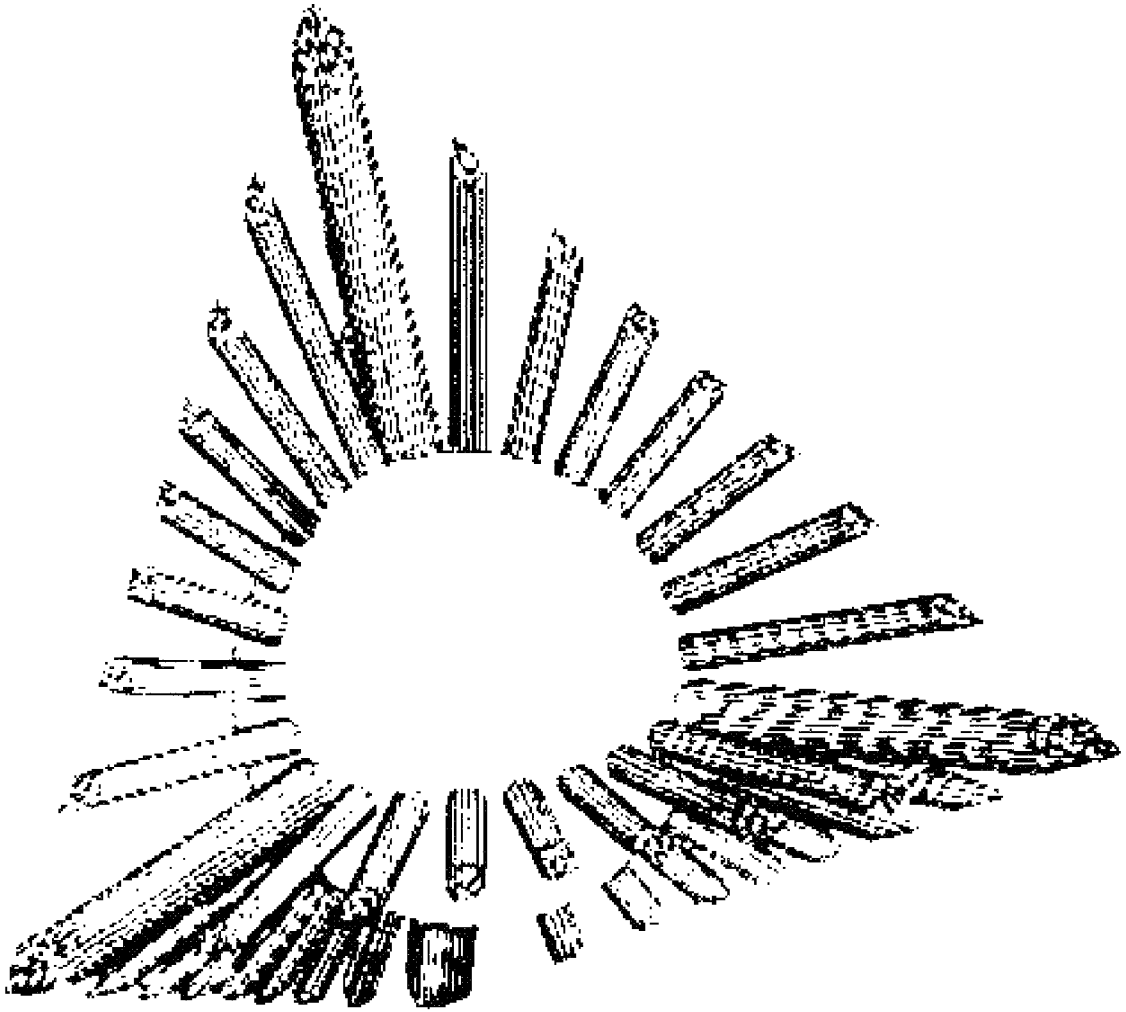
FIG. 1 illustrates a perspective view of an embodiment of a cleaning utensil.
Figure 2A:
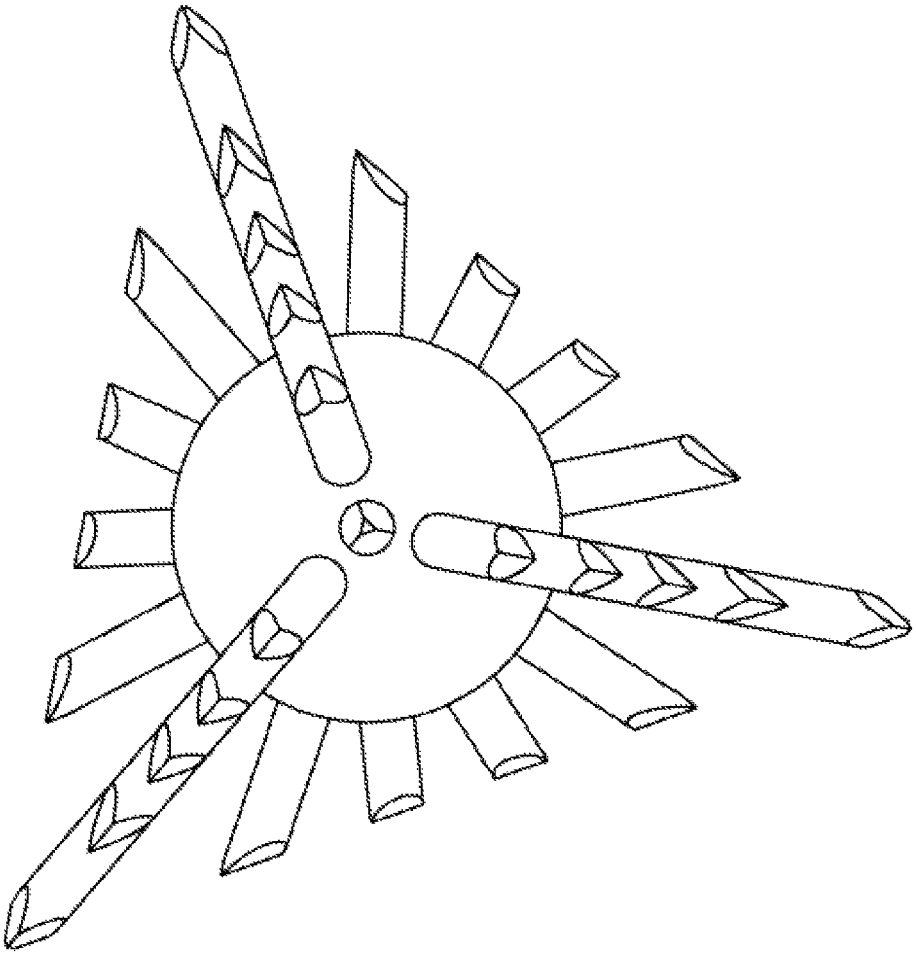
FIG. 2*a* illustrates a top view of a cleaning utensil.
Figure 2B:
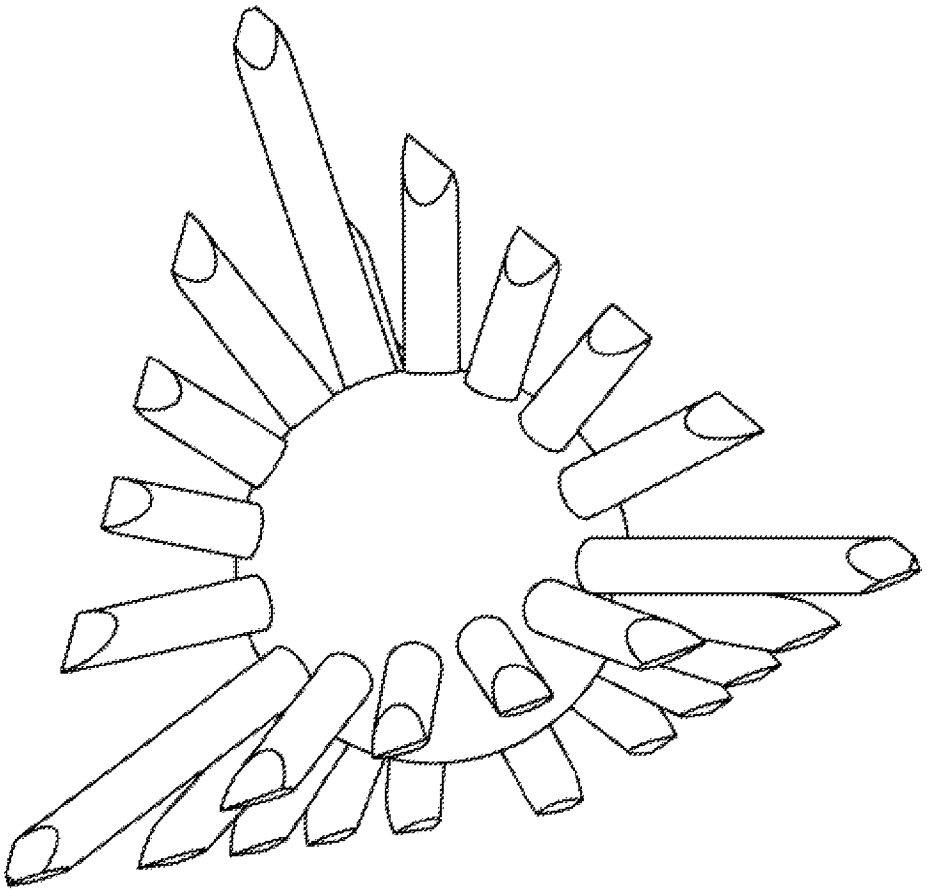
FIG. 2*b* illustrates a perspective, left side view of an embodiment of a cleaning utensil.
Figure 2C:
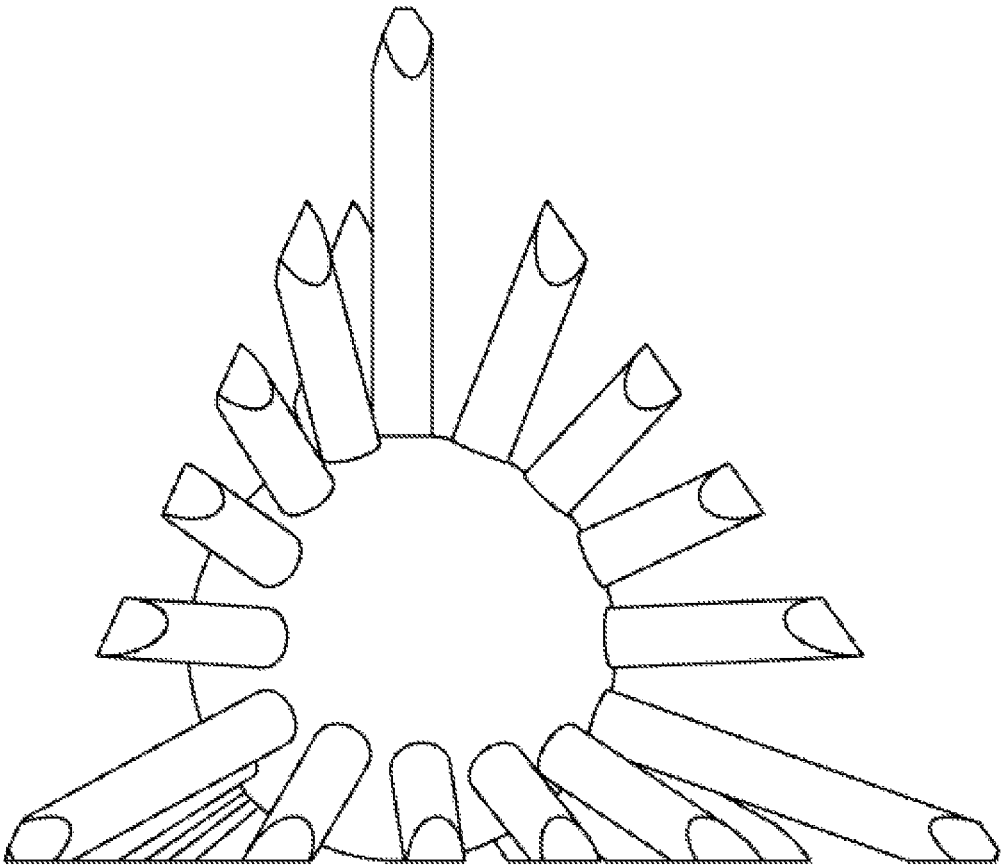
FIG. 2*c* illustrates a perspective, right side view of an embodiment of a cleaning utensil; and, FIG. 2*d* illustrates a front view of an embodiment of a cleaning utensil.
Figure 2D:
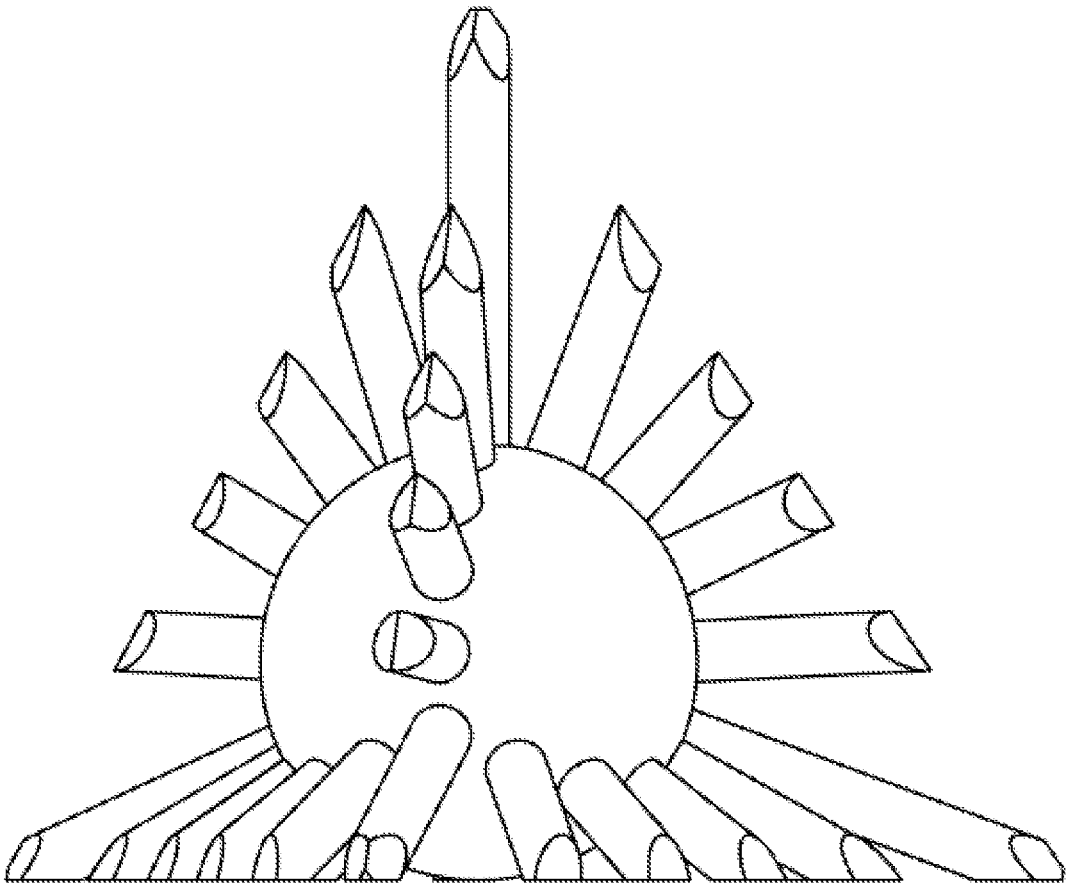
Figure 3A:
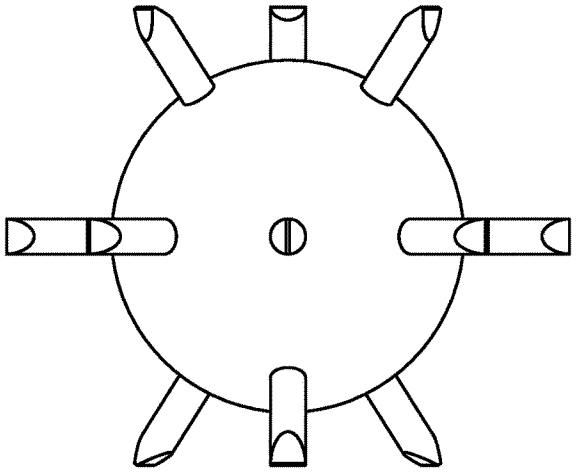
FIG. 3*a* illustrates a side view of an embodiment of a cleaning utensil comprising the central base with 14 bristle assemblies (11 bristle assemblies are shown)
Figure 3B:
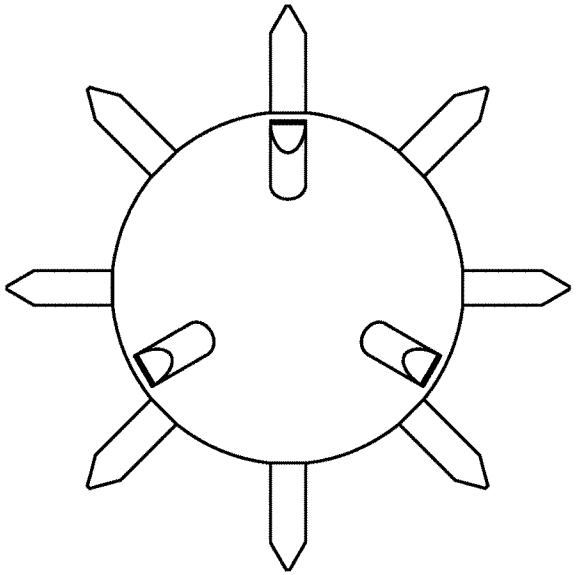
FIG. 3*b* illustrates a top view the embodiment of the cleaning utensil depicted in FIG. 3*a;*
Figure 3C:
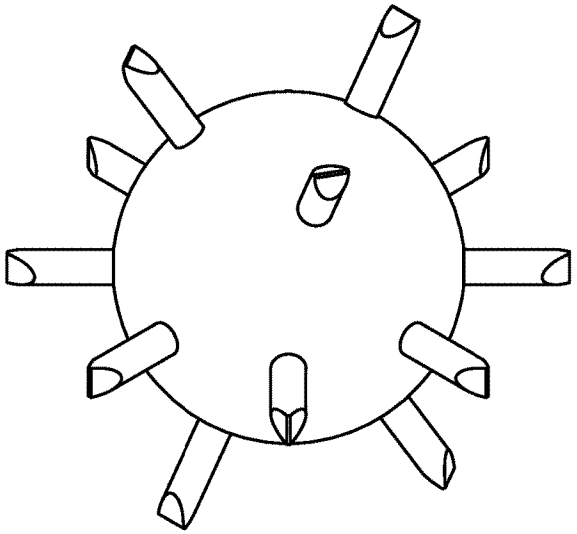
FIG. 3*c* illustrates a perspective view of the embodiment of the cleaning utensil depicted in FIG. 3*a*, in which the left bristle assembly has been rotated along the equator towards the right bristle assembly and also has been rotated downwards.
Figure 4B:
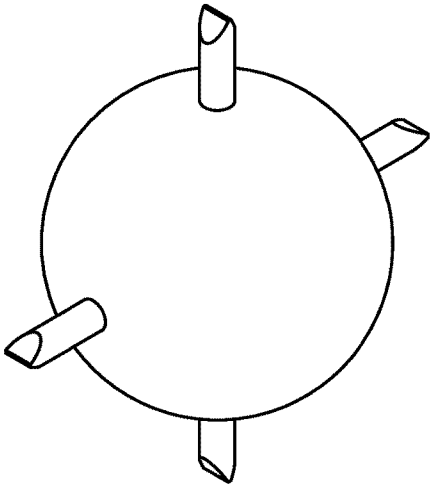
FIG. 4*b* illustrates a back view of the embodiment shown in FIG. 4*a;*
Figure 4A:
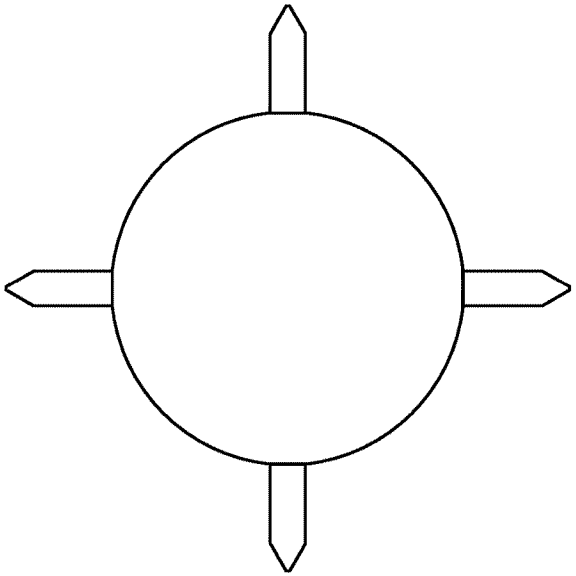
FIG. 4*a* illustrates a front view of an embodiment of a cleaning utensil comprising a central base with 4 bristle assemblies.
Figure 4C:
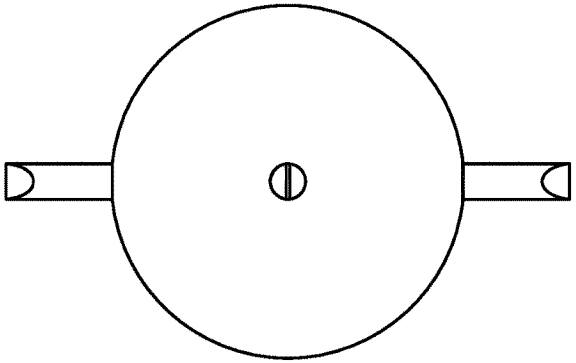
FIG. 4*c* illustrates a perspective view of the embodiment of the cleaning utensil depicted in FIG. 4*a*, in which the left bristle assembly has been rotated along the equator towards the right bristle assembly and also has been rotated downwards.
Figure 5B:
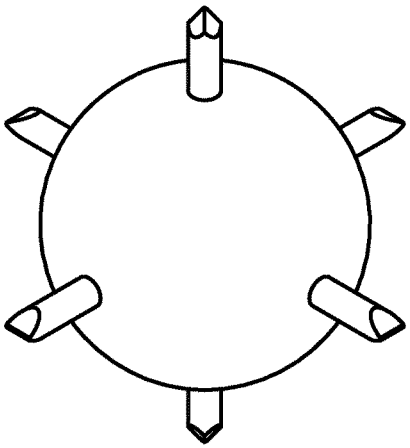
FIG. 5*b* illustrates a bottom view of an embodiment shown in FIG. 5*a* of a cleaning utensil.
Figure 5A:
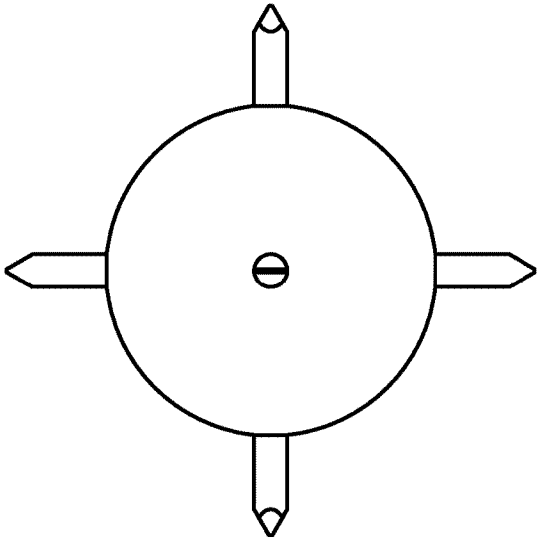
FIG. 5*a* illustrates a top view of an embodiment of a cleaning utensil comprising the central base with 6 bristle assemblies.
Figure 5C:
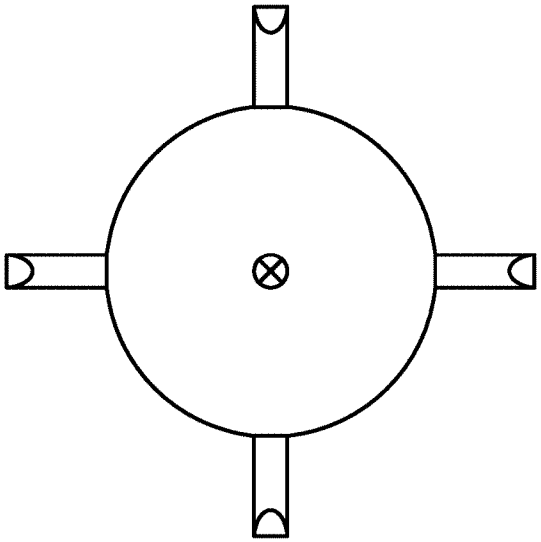
FIG. 5*c* illustrates a perspective view of the embodiment of the cleaning utensil depicted in FIG. 5*a*, in which the left bristle assembly has been rotated along the equator towards the right bristle assembly and also has been rotated downwards.
Figure 6B:
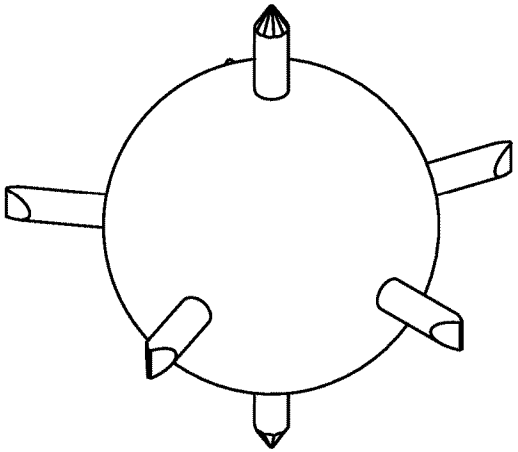
FIG. 6*b* illustrates a bottom view of the embodiment shown in FIG. 6*a;*
Figure 6A:
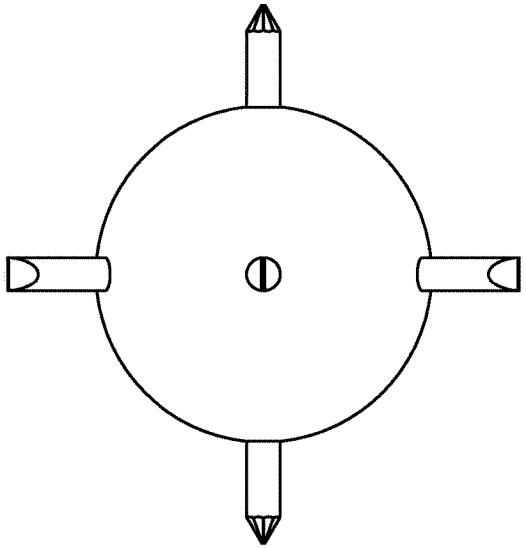
FIG. 6*a* illustrates a top view of an embodiment of a cleaning utensil comprising the central base with 7 bristle assemblies.
Figure 6C:
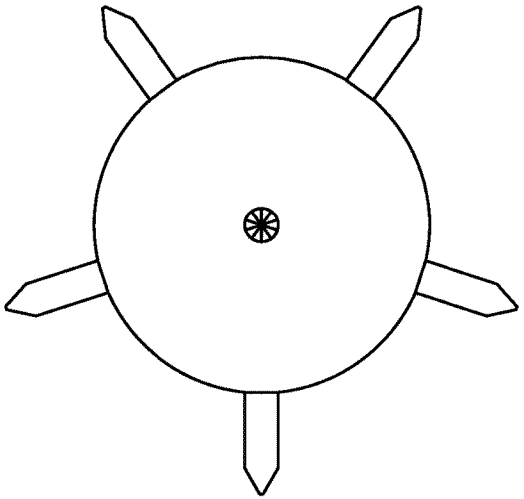
FIG. 6*c* illustrates a perspective view of the embodiment of the cleaning utensil depicted in FIG. 6*a*, in which the left bristle assembly has been rotated along the equator towards the right bristle assembly and also has been rotated downwards.
Figure 7B:
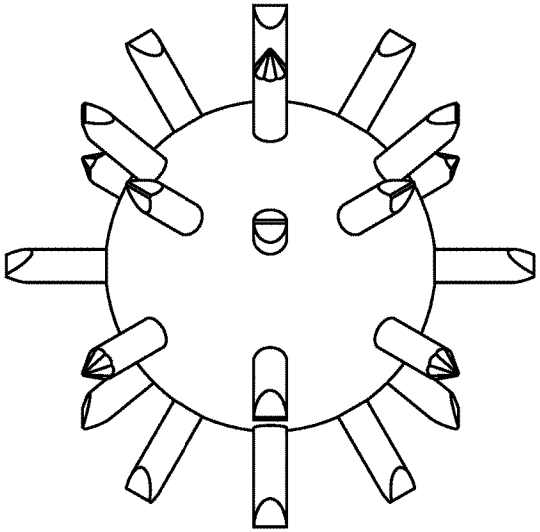
FIG. 7*b* illustrates a bottom view of the embodiment of the cleaning utensil shown in FIG. 7*a;*
Figure 7A:
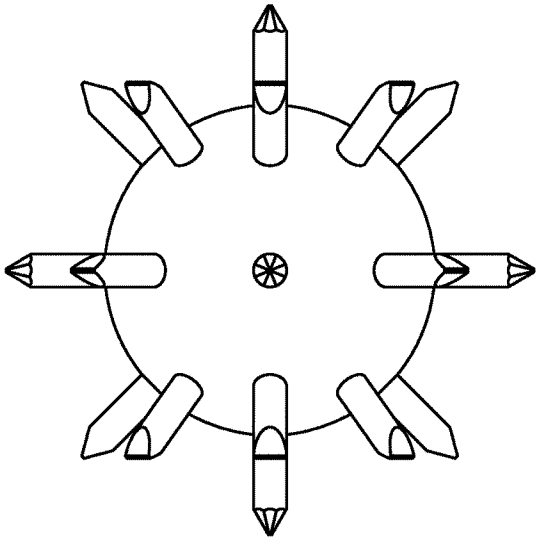
FIG. 7*a* illustrates a top view of an embodiment of a cleaning utensil comprising the central base with 26 bristle assemblies.
Figure 7C:
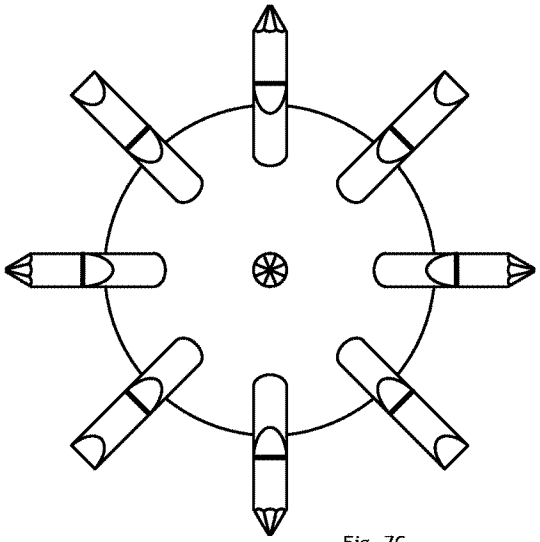
FIG. 7*c* illustrates a perspective view of the embodiment of the cleaning utensil depicted in FIG. 7*a*, in which the left bristle assembly has been rotated along the equator towards the right bristle assembly and also has been rotated downwards.
Figure 8B:
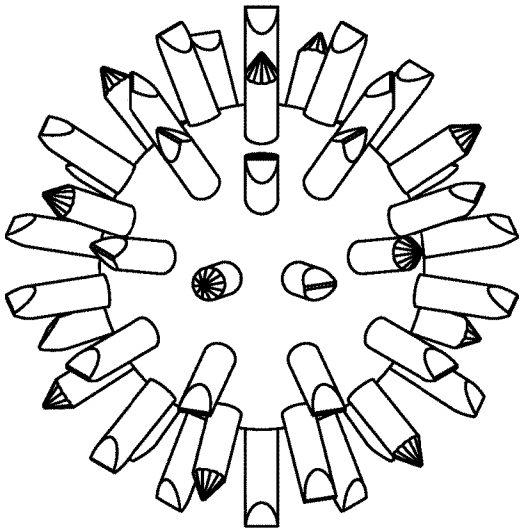
FIG. 8*b* illustrates a bottom view of the embodiment of the cleaning utensil shown in FIG. 8*a;*
Figure 8A:
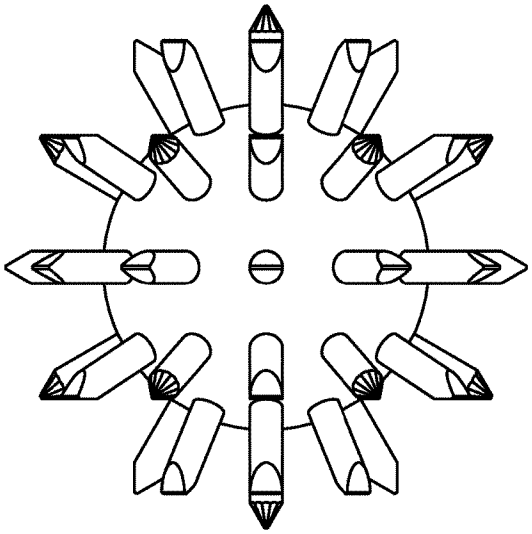
FIG. 8*a* illustrates a top view of the embodiment of a cleaning utensil comprising the central base and 54 bristle assemblies.
Figure 8C:
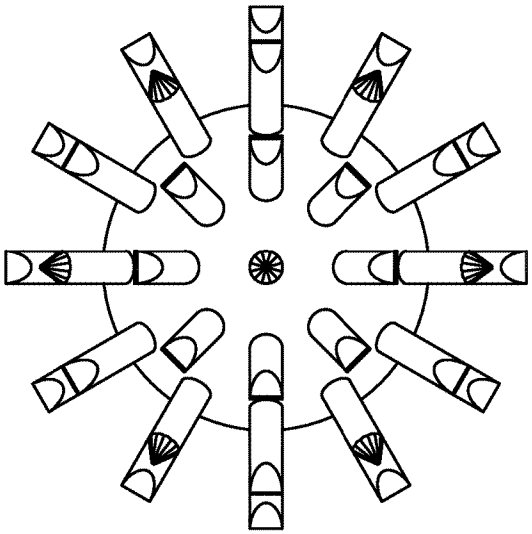
FIG. 8*c* illustrates a perspective view of the embodiment of the cleaning utensil depicted in FIG. 8*a*, in which the left bristle assembly has been rotated along the equator towards the right bristle assembly and also has been rotated downwards.
Figure 9B:
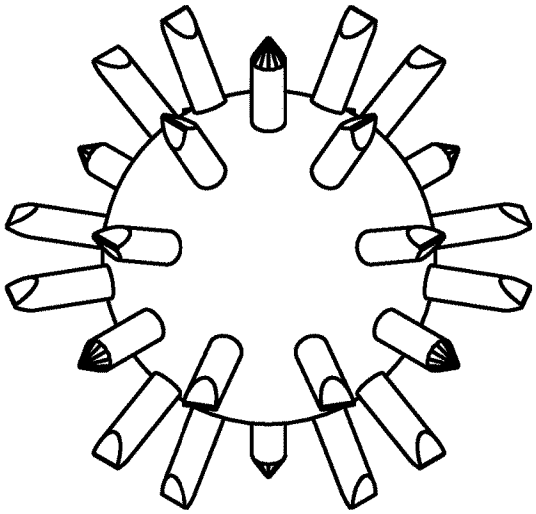
FIG. 9*b* illustrates a bottom view of the embodiment of the cleaning utensil shown in FIG. 9*a.*
Figure 9A:
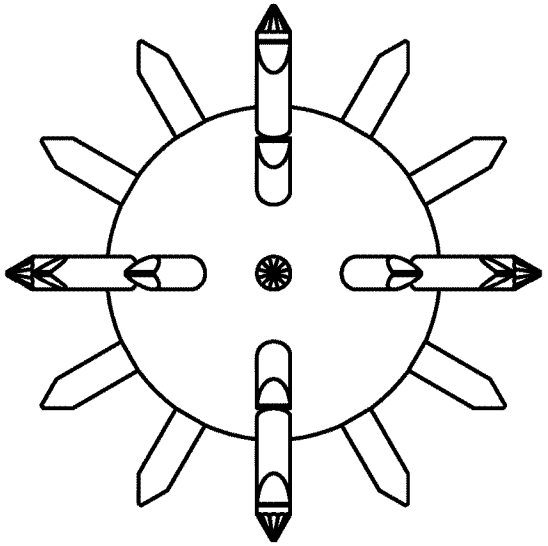
FIG. 9*a* illustrates a top view of an embodiment of a cleaning utensil comprising the central base with 40 bristle assemblies.
Figure 9C:
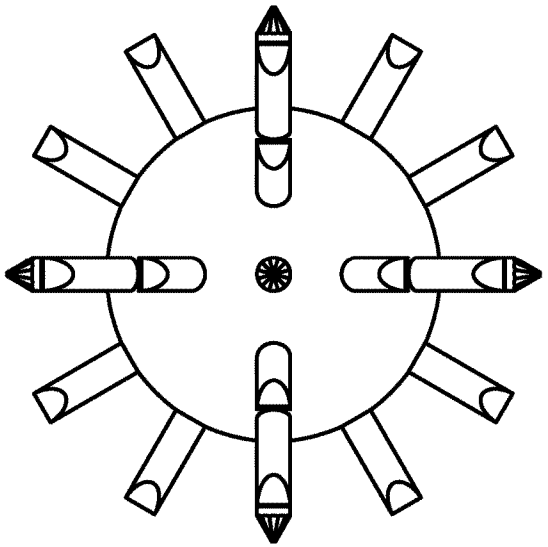
FIG. 9*c* illustrates a perspective view of the embodiment of the cleaning utensil depicted in FIG. 9*a*, in which the left bristle assembly has been rotated along the equator towards the right bristle assembly and also has been rotated downwards.

The foregoing descriptions of embodiments have been presented only for purposes of illustration and description. They are not intended to be exhaustive or to limit the embodiments to the forms disclosed. Accordingly, many modifications and variations will be apparent to practitioners skilled in the art. Additionally, the above disclosure is not intended to limit the embodiments. The scope of the embodiments is defined by the appended claims.

The invention claimed is:

1. A method of using a cleaning utensil comprising:

providing a cleaning utensil comprising a central base, the central base having at least four bristle holders, wherein at least one bristle assembly is coupled to each of the at least four bristle holders, wherein each bristle assembly of the at least one bristle assembly comprises an outer tip, wherein the at least four bristle holders define a substantially trigonal pyramid shape having six edges collectively outlining four faces of the substantially trigonal pyramid shape, wherein the at least four bristle holders define the six edges, wherein a plurality of central areas of the central base collectively below each of the four faces of the substantially trigonal pyramid shape are free from any bristle holders and bristles;

disposing the cleaning utensil within a container;

shaking the container; and, removing the cleaning utensil.

2. A cleaning utensil comprising a central base, the central base having at least twenty four bristle holders, wherein at least one bristle assembly is coupled to each of the at least twenty four bristle holders, wherein each bristle assembly of the at least one bristle assembly comprises an outer tip, wherein the at least twenty four bristle holders define a substantially trigonal pyramid shape having six edges, wherein the at least twenty four bristle holders define the six edges, collectively outlining four faces of the substantially trigonal pyramid shape, wherein a plurality of central areas of the central base collectively below each of the four faces of the substantially trigonal pyramid shape are free from any bristle holders and bristles.

3. A cleaning utensil comprising a central base, the central base having at least four bristle holders, wherein at least one bristle assembly is coupled to each of the at least four bristle holders, wherein each bristle assembly of the at least one bristle assembly comprises an outer tip, wherein the at least four bristle holders define a substantially trigonal pyramid shape having six edges collectively outlining four faces of the substantially trigonal pyramid shape, wherein the at least four bristle holders define the six edges, wherein a plurality of central areas of the central base collectively below each of the four faces of the substantially trigonal pyramid shape are free from any bristle holders and bristles.

4. The cleaning utensil of claim 3 having a first aligned row of bristles, a second aligned row of bristles, a third aligned row of bristles, and a fourth aligned row of bristles, wherein a point on each of the row of bristles defines a plurality of vertices of a shape selected from a group consisting of a trigonal pyramid shape and a tetrahedral shape.

5. The cleaning utensil of claim 3 having a first aligned row of bristles, a second aligned row of bristles, a third aligned row of bristles, and a fourth aligned row of bristles, wherein a centralized point on each of the row of bristles defines a plurality of vertices of a shape selected from a group consisting of a trigonal pyramid shape and a tetrahedral shape.

6. The cleaning utensil of claim 3, wherein the central base is a metallic sphere.

7. The cleaning utensil of claim 6, wherein the central base is a metallic sphere enclosed in a cover.

8. The cleaning utensil of claim 6, wherein the at least four bristle holders define a trigonal pyramid shape.

9. The cleaning utensil of claim 6, wherein each of the at least one bristle assembly coupled to each of the at least four bristle holders are disposed within one of the at least four bristle holders, wherein each outer tip of the at least one bristle assembly of the at least four bristle holders collectively define a substantially trigonal pyramid shape.

10. The cleaning utensil of claim 6, wherein the at least four bristle holders number no more than 54.

11. The cleaning utensil of claim 6, wherein the at least four bristle holders number less than 40.

12. The cleaning utensil of claim 6, wherein the at least four bristle holders number less than 29.

13. The cleaning utensil of claim 6, wherein the central base is a metallic sphere enclosed in a silicone cover, exclude other bristle holders from being on the plurality of central areas of the central base.

14. The cleaning utensil of claim 6 wherein an angle between a first aligned row of bristles in a first bristle assembly line and a second aligned row of bristles is substantially 109.5 degrees.

15. The cleaning utensil of claim 14 wherein the first aligned row of bristles in the first bristle assembly line define an edge of a shape selected from a group consisting of a tetrahedral and a trigonal pyramid shape.

* * * * *